United States Patent [19]

Prewer

[11] 4,039,181

[45] Aug. 2, 1977

[54] AUTOMATIC COUPON DISPENSING APPARATUS

[75] Inventor: Richard Wayne Prewer, Toronto, Canada

[73] Assignee: Egg Sales Promotion Inc., Markham, Canada

[21] Appl. No.: 630,279

[22] Filed: Nov. 10, 1975

[30] Foreign Application Priority Data

Dec. 6, 1974 Canada ..... 215550

[51] Int. Cl.[2] ..... B65H 5/06

[52] U.S. Cl. ..... 271/10; 221/13; 221/231; 221/259; 271/126; 271/149

[58] Field of Search ..... 221/7, 9, 13, 225, 242, 221/231, 258, 277, 259; 271/124, 126, 149, 150, 171, 10; 192/142 R

[56] References Cited

U.S. PATENT DOCUMENTS

| | | | |
|---|---|---|---|
| 1,909,050 | 5/1933 | Ferguson | 221/231 X |
| 2,079,837 | 5/1937 | Buckley | 192/142 R |
| 2,080,968 | 5/1937 | Krell | 271/124 |
| 2,705,636 | 4/1955 | Bombard | 271/124 |
| 3,410,452 | 11/1968 | Igel et al. | 221/13 |
| 3,556,345 | 1/1971 | Rowekamp | 221/242 |
| 3,746,211 | 7/1973 | Burgess | 221/13 X |

*Primary Examiner*—Robert B. Reeves
*Assistant Examiner*—Joseph J. Rolla
*Attorney, Agent, or Firm*—George H. Riches and Associates

[57] ABSTRACT

This invention relates to a coupon dispenser for automatically dispensing advertising or promotional coupons into open product containers such as egg cartons passing on a conveyor. The dispenser has a body with a horizontally inclined surface on which a deck of coupons are stood between a coupon support member on the forward side and a slidable weight on the rearward side. A rotatable drive wheel is positioned above the inclined surface forwardly adjacent the coupon support member to slightly project through a window in the lower end of the coupon support member to contact the adjacent coupon. A pair of rotatable rollers are located downstream from the drive wheel to assist in drawing out the coupon and dispensing it into the positioned container. An electric motor drives the drive wheel through a solenoid operated friction clutch and brake to rotate it one revolution each time a microswitch indicates a container is in position on the conveyor to receive a coupon. When the drive wheel is rotated, it frictionally engages the adjacent coupon and draws it beneath the support member down the inclined surface between the rollers and into the passing container. The relationship between the characteristics of the coupons and the position of the coupon support member relative to the drive wheel and inclined surface is critical to consistent operation. Therefore, the coupon support member is mounted on the body to be horizontally, vertically and pivotally adjustable. A light and photocell connected to a counter are positioned whereby each coupon dispensed is counted when it interrupts the light beam.

8 Claims, 4 Drawing Figures

AUTOMATIC COUPON DISPENSING APPARATUS

BACKGROUND OF THE INVENTION

This invention relates generally to coupon dispensing apparatus and more particularly to apparatus for automatically dispensing coupons into containers being carried on an adjacent conveyor.

It is well known in the marketing field to include discount coupons or other promotional literature in packages of consumer products such as eggs. In the past, a serious disadvantage of this method of promotion has been the difficulty and cost of making an insertion into each container during packaging. It has been found that manual insertion of the coupons into the containers on a volume basis is entirely too costly. While attempts have been made to automate this process with apparatus designed to insert coupons into open containers passing by on a conveyor during packaging, this apparatus has proven to be unreliable in that it does not consistently insert a single coupon into each container and is subject to frequent breakdown. Furthermore, these previous automatic coupon dispensing devices have the disadvantage that they are not readily adaptable to dispense coupons having different characteristics such as thickness and flexibility.

SUMMARY OF THE INVENTION

Accordingly, it is an object of the present invention to at least partially overcome these disadvantages by providing a coupon inserter which may be located adjacent to a container carrying conveyor, adjusted to a particular type of coupon, loaded with a deck of these coupons and which will function automatically to economically consistently dispense a single one of the coupons into each of the open containers passing by on the conveyor.

To this end, in one of its aspects, the invention provides (a) a body having a horizontally inclined surface directed forwardly downward towards the containers on the conveyor, (b) holding means adapted to receive a deck of coupons resting on end on the inclined surface, (c) a rotatable drive wheel mounted on the body above the inclined surface forwardly adjacent the coupons and adapted to frictionally engage an adjacent coupon during rotation to dispense it by downwardly displacing it along the inclined surface, (d) drive means adapted to periodically rotate the drive wheel, and (e) switch means adapted to synchronize operation of the drive means and conveyor to dispense a coupon into each passing container.

In another of its aspects, the invention further provides (a) a body having an elongated horizontally inclined surface and a vertical wall extending upward along one side of the inclined surface, the inclined surface being directed forwardly downward towards the containers on the conveyor, (b) a coupon support member secured to the body in a horizontally, vertically and pivotally adjustable upright position above the inclined surface and a weight with an upright forward surface slidably positioned on the inclined surface rearwardly from the support member, the support member and weight adapted to receive therebetween a deck of resilient flexible coupons supported on end by the inclined surface, (c) a rotatable drive wheel rotatably mounted on the body above the inclined surface forwardly adjacent the coupon support member to project rearwardly through a lower window in the support member adjacent the inclined surface, at least a portion of the surface of the drive wheel being formed of a high friction material to frictionally engage an adjacent coupon during rotation of the wheel to displace it downwardly and forwardly along the inclined surface, (d) drive means comprising an electric motor connected through a solenoid operated friction clutch and brake to the drive wheel to rotate the drive wheel one revolution each time when the solenoid is energized, and (d) a switch actuated by the conveyor and electrically connected to energize the solenoid to synchronize rotation of the drive wheel to dispense a coupon into each passing container.

Further objects and advantages of the invention will appear from the following description taken together with the accompanying drawings.

DESCRIPTION OF THE PREFERRED EMBODIMENTS

Figure 1:
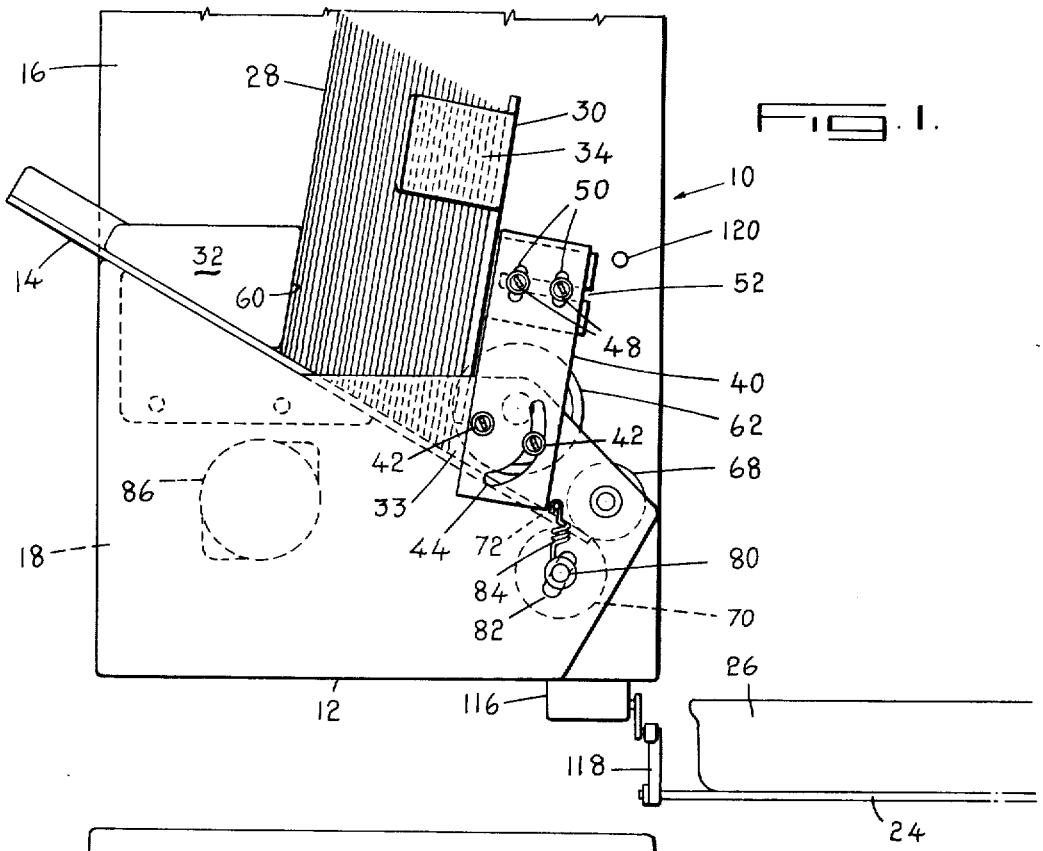
FIG. 1 is a side elevation view of dispensing apparatus according to a preferred embodiment of the invention showing a container on an adjacent conveyor.
Figure 3:
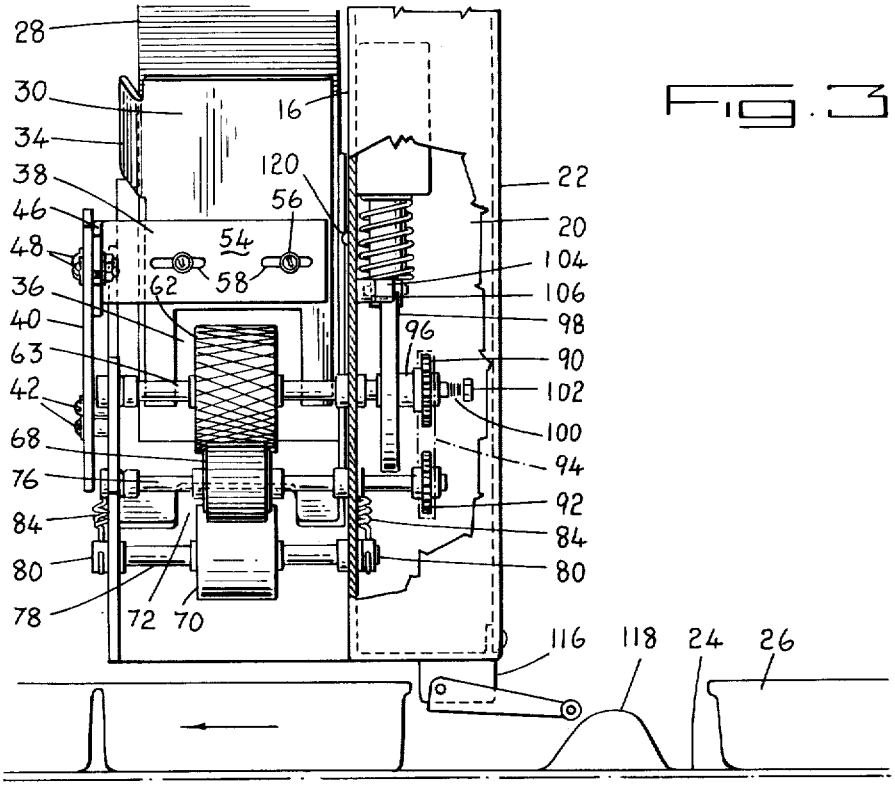
FIG. 3 is a front elevation view of the preferred embodiment of the invention.
Figure 4:
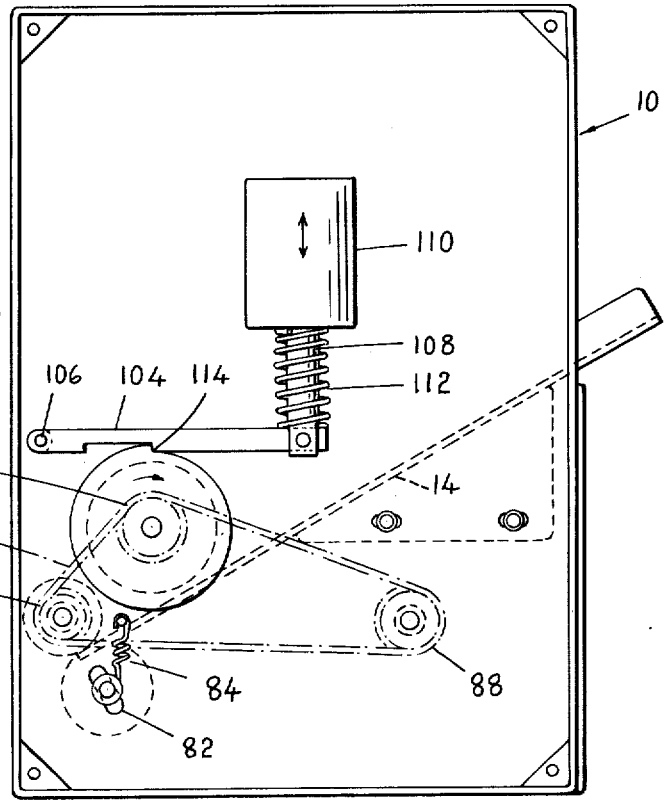
FIG. 4 is a side elevation view of the same apparatus from the opposite side to FIG. 1 with the cover plate removed.

Reference is first made to FIG. 1 which shows the coupon dispensing apparatus having a body 10 with a base 12, an elongated horizontally inclined surface 14 and a vertical wall 16 extending upward beside the inclined surface 14. The body 10 has a lower enclosed portion 18 between the base 12 and the inclined surface 14 and a second enclosed portion 20 between the vertical wall 16 and a cover plate 22 (best seen in FIG. 3).

The apparatus is located adjacent a conveyor 24 which carries open filled containers 26 such as egg cartons past the dispenser. The inclined surface 14 is formed of steel and is inclined downwardly approximately 30° from the horizontal towards the passing containers 26. The inclined surface 14 may of course be formed of other suitable materials and the angle of inclination from the horizontal may vary from approximately 10° to 45°. The inclined surface 14 carries a deck of coupons 28 which rest on end on the inclined surface between a fixed coupon support member and a slidable weight 32. The coupon support member 30 is substantially flat with an upper outer wing 34 projecting rearwardly to retain the coupons 28 in place on the inclined surface and has a rectangular window 36 centrally located adjacent its lower end. The support member 30 is mounted to the body 10 by horizontal L-shaped bracket 38 and vertical bracket 40 to provide a space 33 between its lower end and the inclined surface 14. The position of the support member 30 may be horizontally, vertically or pivotally adjusted to correspond to the characteristics of the coupons 28 being dispensed. The vertical bracket 40 is fixed to the body 10 by a pair of lower bolts 42, one of which extends through a curved slot 44 in the vertical bracket 40 to enable the position of the vertical bracket 40 and therefore the support member 30 to be pivotally adjusted relative to the body 10. A first arm 46 of the L-shaped bracket 38 is fixed to the vertical bracket 40 near its upper end by an upper pair of bolts 48. These bolts 48 extend through a pair of vertical slots 50 in the vertical bracket 40 and a horizontal slot 52 in the first arm 46 of the L-shaped bracket 38 which enables the L-shaped bracket 38 and therefore the support member 30 to be adjusted both vertically and horizontally forwardly rearwardly. The coupon support member 30 is secured above the window 36 to a second arm 54 of the L-shaped bracket 38 by a further pair of bolts 56 which extend through a pair of horizontal slots 58 in the second arm 54 of the L-shaped bracket 38 to permit the position of the coupon support member 30 to be horizontally adjusted inwardly-outwardly. Weight 32 is slidably located on the inclined surface 14 above the deck of coupons 28 and has an upwardly extending surface 60 in bearing contact with the coupons whereby the gravitational force of the weight continually urges the coupons forwardly downward against the coupon support member 30.

A cylindrical drive wheel 62 fixed to a drive wheel shaft 63 is rotatably mounted on the body 10 in a position slightly above the inclined surface 14 forwardly of the support member 30 with a small portion of its circumference extending through the window 36 to contact the forwardmost coupon of the deck 28. A first portion 64 of the surface of the drive wheel 62 (seen in FIG. 2) is formed of a high friction material, neoprene golf ball finish 3 ply friction belting, while a second portion 66 of the surface of the drive wheel 62 is formed of steel, a low friction material. An upper roller 68 and a lower roller 70 are rotatably mounted on the body 10 in a cutout 72 in the forward edge of the inclined surface 14 to contact each other in substantial alignment with the inclined surface. The surface of the upper roller 68 is formed of a layer of rubber 74, while the surface of the lower roller 70 is formed of steel. The position of the upper roller 68 is fixed on a rotatable shaft 76 while lower roller 70 is mounted on lower rotatable shaft 78 which has ends 80 projecting through slots 82 in the body 10. The end 80 of the shaft 78 extending through the slots 82 are upwardly spring loaded by springs 84 attached to the body 10 to continually bias the surface of the movable lower roller 70 against the surface of the fixed upper roller 68.

A small electric motor 86 is located in the lower enclosed portion 18 of the body 10 below the inclined surface 14 with a drive sprocket 88 fixed to its output shaft in the second enclosed portion 20 of the body 10. A drive wheel sprocket 90 on drive wheel shaft 63 and a roller sprocket 92 on upper rotatable shaft 76 are connected to the drive sprocket 88 by a chain 94 and driven continuously when the motor 86 is operating. A friction bearing is provided between the drive wheel sprocket 90 and the drive wheel shaft 63 by a neoprene clutch disc 96 which is fixed to the drive wheel sprocket 90 and positioned against a clutch plate 98 which is fixed to the drive wheel shaft 63. A compression spring 100 forces the clutch disc 96 against the clutch plate 98 and the degree of compression may be adjusted by nut 102 to ensure frictional engagement between the clutch disc 96 and the clutch plate 98.

A brake is provided by a notched arm 104 which is pivotally connected at one end to the body 10 by connector 106 and at the other end to solenoid shaft 108. When the solenoid 110 is de-energized, a compression spring 112 pivots notched arm 104 downwardly to about connector 106 engage a matching notch 114 in clutch plate 98 which prevents the drive wheel 62 from rotating.

A microswitch 116 is mounted to be activated by projections 118 on the conveyor 24 corresponding to the positions of the containers 26 and is electrically connected to the solenoid 110. It is apparent that other suitable means such as a cam mounted on one of the conveyor idlers or drive wheels could alternatively be used to activate the microswitch. A light source 120 is mounted to direct a beam of light through an opening 122 in the inclined surface 14 to a photocell 124. The photocell is electrically connected to a counter 126 to count the number of times the light beam is interrupted by a coupon being dispensed downwardly along the inclined surface 14. The wiring arrangements to provide these electrical connections follow conventional practices and need not be described in detail. Also provided in a conventional manner on the exterior of the body 10 are a power off/on toggle switch, replaceable fuse and power indicating light.

Figure 2:
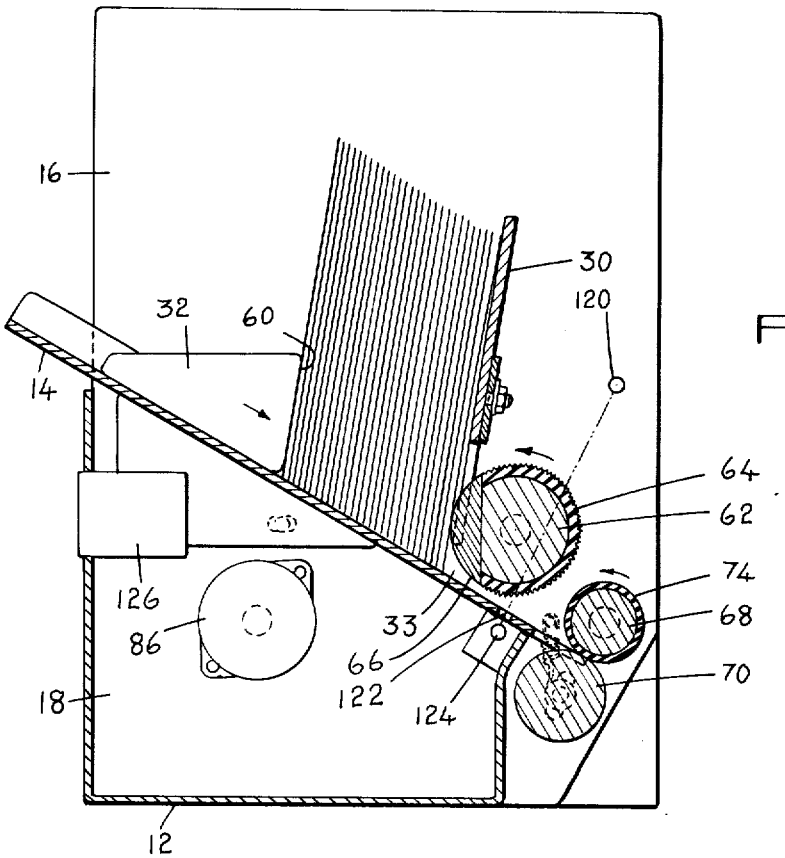
FIG. 2 is a sectional view similar to FIG. 1.

In use, when the power is turned on the motor 86 operates to continuously drive the roller sprocket 92 and the drive wheel sprocket 90. Thus, the upper roller 68 rotates in a counterclockwise direction, (as seen in FIG. 2) and contacts lower roller 70 to drive it in a coounterclockwise direction. However, as solenoid 110 is normally de-energized, the notched arm 104 engages the clutch plate 98 to prevent the drive wheel 62 from rotating. When microswitch 116 indicates that the conveyor 24 has brought a container 26 into position to receive a coupon, solenoid 110 is momentarily energized to lift the solenoid shaft 108 upward against the compression spring 112 to disengage the notched arm 104 from the notch 114 in the clutch plate 98. The clutch disc 96 fixed to the drive wheel sprocket 90 frictionally engages the clutch plate 98 causing the drive wheel 62 to rotate counterclockwise (as seen in FIG. 2). When the solenoid 110 is de-energized, the notched arm 104 rides on the rotating clutch plate 98 until it has rotated one revolution when the notched arm 104 is again biased downwardly to engage the notch 114 in clutch plate 98 to brake rotation of the drive wheel 62. Referring to FIG. 2, during this single rotation of the drive wheel 62 the high friction material of the first portion 64 of its outer surface frictionally engages the forwardmost coupon and displaces it downwardly along the inclined surface 14 through the space 33 under the coupon support member 30 and into engagement between upper and lower rollers 68, 70. These rollers assist in drawing the coupon downward, disengage it from the drive wheel 62 and dispense it into the positioned container 26. The container 26 is then moved on by the conveyor 24 and this process repeated for the next container.

It is apparent that in order for the coupons to pass through space 33 below the coupon support member 30 it is necessary for them to bend substantially and therefore in order for the coupons to be presentable when the containers are opened it is necessary for them to be somewhat resilient.

It has been found that the relationship between the position of the coupon support member 30 relative to the drive wheel 62 and the inclined surface 14 and the characteristics of the coupon being dispensed is critical to consistent performance of the apparatus. In the position shown, the angle between the coupon support member 30 and the inclined surface 14 is approximately 70°. Generally, for thicker less resilient coupons the coupon support member 30 is raised, pivoted to slightly decrease this angle, and moved closer to the cylindrical drive wheel 62 to provide additional frictional contact between the drive wheel and the adjacent coupon, with the reverse for thinner coupons.

Although the description of this invention has been given with respect to a particular embodiment of the coupon dispensing apparatus, it is not to be construed in a limiting sense. Many variations and modifications of the structure will occur to those skilled in the art. For a definition of the invention reference is made to the appended claims.

What I claim is:

1. Apparatus for automatically dispensing coupons into containers being carried on an adjacent conveyor comprising:

a. a body having a horizontally inclined surface directed forwardly downward towards the containers on the conveyor;

b. holding means adapted to receive a deck of coupons resting on end on the inclined surface, the holding means including:

i. a coupon support member secured to the body having an upper portion and a lower portion spaced above the inclined surface in a position forwardly adjacent the coupons with a window in the lower portion adjacent the inclined surface, at least the upper portion of the coupon support member being horizontally, vertically and pivotally adjustable on the body relative to the inclined surface to enable the apparatus to be adjusted to feed coupons of different thickness, flexibility and resiliency, and ii. a weight slidably positioned on the inclined surface rearwardly from the coupons, whereby the force of gravity on the weight continuously urges the deck of coupons forwardly against the coupon support member;

c. a rotatable drive wheel mounted on the body above the inclined surface forwardly adjacent the coupons to project slightly rearwardly through the window in the coupon support member to contact the adjacent coupon to frictionally engage it during rotation of the wheel to dispense it by downwardly displacing it along the inclined surface;

d. drive means adapted to periodically rotate the drive wheel; and e. switch means adapted to synchronize operation of the drive means and conveyor to dispense a coupon into each passing container.

2. Coupon dispensing apparatus as claimed in claim 1 wherein upper and lower rollers are mounted in spring loaded contact therebetween on the body in substantial alignment with and adjacent to the lower end of the inclined surface to receive the displaced coupons therebetween, at least one of the rollers being driven by the drive means to draw the coupons down the inclined surface and dispense them into the containers.

3. Apparatus of claim 1, wherein the coupon is discharged from the apparatus at an angle which substantially corresponds to the angle of said inclined surface.

4. Apparatus of claim 1, wherein said body includes a vertical guide means extending above one side of the inclined surface to guide the coupons during forward travel along the inclined surface to contact with the coupon support member.

5. Apparatus of claim 1, wherein the coupon is displaced by the drive wheel downwardly along said inclined surface to the nip of a pair of rollers, at least one of said rollers being driven to draw the coupon down the inclined surface and discharge it into a container.

6. Apparatus of claim 5, wherein the coupon is discharged from the apparatus at an angle which substantially corresponds to the angle of said inclined surface.

7. Apparatus for automatically dispensing coupons into containers being carried on an adjacent conveyor comprising:

a. a body having an elongated horizontally inclined surface and a vertical wall extending upward along one side of the inclined surface, the inclined surface being directed forwardly downward towards the containers on the conveyor;

b. a coupon support member secured to the body having an upper portion and a lower portion, at least the upper portion being in a horizontally, vertically and pivotally adjustable upright position above the inclined surface and a weight with an upright forward surface slidably positioned on the inclined surface rearwardly from the support member, the support member and weight adapted to receive therebetween a deck of resilient flexible coupons supported on end by the inclined surface;

c. a rotatable drive wheel rotatably mounted on the body above the inclined surface forwardly adjacent the coupon support member to project rearwardly through a window in the lower portion of the support member adjacent the inclined surface, at least a portion of the surface of the drive wheel being formed of a high friction material to frictionally engage an adjacent coupon during rotation of the wheel to displace it downwardly and forwardly along the inclined surface;

d. drive means comprising an electric motor connected through a solenoid operated friction clutch and brake to the drive wheel to rotate the drive wheel one revolution each time when the solenoid is energized; and e. a switch actuated by the conveyor and electrically connected to energize the solenoid to synchronize rotation of the drive wheel to dispense a coupon into each passing container.

8. Apparatus for automatically dispensing coupons into containers being carried on an adjacent conveyor comprising:

a. a body having a horizontally inclined surface directed forwardly downward towards the containers on the conveyor;

b. holding means adapted to receive a deck of coupons resting on end on the inclined surface, the holding means including:

i. a coupon support member secured to the body spaced above the inclined surface in a position forwardly adjacent the coupons with a lower window adjacent the inclined surface, the coupon support member being horizontally, vertically and pivotally adjustable on the body relative to the inclined surface to enable the apparatus to be adjusted to feed coupons of different thickness, flexibility and resiliency, and ii. a weight slidably positioned on the inclined surface rearwardly from the coupons, whereby the force of gravity on the weight continuously urges the deck of coupons forwardly against the coupon support member;

c. a rotatable drive wheel mounted on the body above the inclined surface forwardly adjacent the coupons to project slightly rearwardly through the window in the coupon support member to contact the adjacent coupon to frictionally engage it during rotation of the wheel to dispense it by downwardly displacing it along the inclined surface, said drive wheel having first and second circumferential portions, respectively formed of high and low friction materials, of the outer surface thereof;

d. drive means adapted to periodically rotate the drive wheel, said drive wheel including a motor connected through a solenoid operated friction clutch to the drive wheel and brake means operated by the solenoid; and e. switch means adapted to synchronize operation of the drive means and conveyor to dispense a coupon into each passing container, the switch means comprising a microswitch actuated by the conveyor and electrically connected to the solenoid, whereby the drive wheel is rotated a single revolution to dispense a single coupon only when a container is in position to secure said coupon.

* * * * *